US006173147B1

(12) United States Patent
Nakashima et al.

(10) Patent No.: US 6,173,147 B1
(45) Date of Patent: Jan. 9, 2001

(54) WET TYPE ELECTROPHOTOGRAPHY APPARATUS TO HEAT TONER ON INTERMEDIATE TRANSFER MEDIUM

(75) Inventors: Yutaka Nakashima, Kanazawa; Akihiko Inamoto; Shigrki Uesugi, both of Kahoku-gun; Satoru Moto, Kanazawa; Motoharu Ichida, Kahoku-gun; Masanari Takabatake, Kanazawa; Shigeharu Okano, Hakui; Seiichi Takeda, Kanazawa, all of (JP)

(73) Assignee: PFU Limited, Ishikawa (JP)

( * ) Notice: Under 35 U.S.C. 154(b), the term of this patent shall be extended for 0 days.

(21) Appl. No.: 09/284,136

(22) PCT Filed: Aug. 27, 1998

(86) PCT No.: PCT/JP98/03801

§ 371 Date: Jun. 24, 1999

§ 102(e) Date: Jun. 24, 1999

(87) PCT Pub. No.: WO99/10778

PCT Pub. Date: Mar. 4, 1999

(30) Foreign Application Priority Data

| | | |
|---|---|---|
| Aug. 27, 1997 | (JP) | 9-230137 |
| Dec. 2, 1997 | (JP) | 9-331341 |
| Jul. 14, 1998 | (JP) | 10-198328 |

(51) Int. Cl.[7] ..... G03G 15/20
(52) U.S. Cl. ..... 399/308; 399/302
(58) Field of Search ..... 399/302, 308, 399/233, 237

(56) References Cited

U.S. PATENT DOCUMENTS

| | | | | |
|---|---|---|---|---|
| 4,453,820 | * | 6/1984 | Suzuki | 399/308 |
| 4,796,048 | * | 1/1989 | Bean | 399/308 |
| 5,493,373 | * | 2/1996 | Gundlach et al. | 399/302 |
| 6,002,907 | * | 12/1999 | Berkes | 399/302 X |

FOREIGN PATENT DOCUMENTS

| | | |
|---|---|---|
| 4-502218 | 4/1992 | (JP) . |
| 4-163482 | 6/1992 | (JP) . |
| 7-92856 | 4/1995 | (JP) . |
| 7-239615 | 9/1995 | (JP) . |

* cited by examiner

*Primary Examiner*—Fred L. Braun

(57) ABSTRACT

A wet type electrophotography apparatus according using a non-volatile, high-viscosity, high-concentration liquid toner as a developing solution, and including a photoconductive medium on which an electrostatic latent image is formed, a prewetting device for coating the surface of the photoconductive medium with a film of prewetting solution, a developing device, an intermediate transfer medium for transferring the toner particles deposited on the photoconductive medium, a pressure roller rotating in contact with the intermediate transfer medium for transferring a printing medium while forcing the printing medium onto the intermediate transfer medium, and a heating device for heating locally the surface of the intermediate transfer medium at a location immediately before the intermediate transfer medium comes in contact with the pressure roller. The wet-type electrophotography apparatus can efficiently heat and fuse the toner transferred on the intermediate transfer medium without causing thermal effects on the photoconductive medium.

37 Claims, 10 Drawing Sheets

When heating belt is retracted

When heating belt contacts with IMR

WET TYPE ELECTROPHOTOGRAPHY APPARATUS TO HEAT TONER ON INTERMEDIATE TRANSFER MEDIUM

FIELD OF THE INVENTION

This invention relate to a wet type electrophotography apparatus using a non-volatile, high-viscosity, high-concentration liquid toner, and more specifically to a wet type electrophotography apparatus having a construction using an intermediate transfer medium in which the toner transferred on the intermediate transfer medium can be efficiently heated and fused without causing adverse thermal effects on a photoconductive medium.

BACKGROUND ART

In electrophotography apparatuses where an electrostatic latent image is formed on a photoconductive medium; a toner is caused to be deposited on the charged image area, and the powder image thus formed is then transferred to paper and fused there by heat, a dry type involving a powder toner has been widely used.

The powder toner used in the dry type electrophotography apparatus, however, tends to be easily carried about in the air, and has relatively poor resolution because of its large particle sizes ranging from 7~10 $\mu$m.

Where a high resolution is needed, therefore, a wet type electrophotography using a liquid toner is preferred. The liquid toner has particle sizes as small as approx. 1 $\mu$m and a high charging capacity, with the result that the toner image is less susceptible to turbulence, leading to improved resolution.

In conventional wet type electrophotography apparatuses, a low-viscosity liquid toner composed of 1~2% of toner mixed in an organic solvent is used as a developer. This type of developer solution, however, arouses environmental concerns since it uses an organic solvent that causes hazards to human bodies, and it is generally consumed in a large amount due to its low toner concentration.

It is against this background that an invention involving a wet type lectrophotography apparatus using a high-viscosity, high-concentration developer solution consisting of a high-concentration toner dispersed in silicone oil was disclosed in international Disclosure Number "WO95/08792".

The use of this liquid toner is beneficial because it is not hazardous to human bodies, and because the toner of a high concentration eliminates the need for a large amount of developer solution.

A known method of fixing a toner deposited on an electrostatic latent image on the photoconductive medium is to transfer the toner particles deposited on the photoconductive medium directly onto a printing medium without using an intermediate transfer medium. In processing color images, however, the method of transferring the toner deposited on the photoconductive medium directly onto a printing medium relying on the force of electric field, and fusing the toner there by heating the printing medium would have to pass the printing medium over the photoconductive medium at least three times (four times when realizing black color with a single toner). This would limit the type and material of printing medium, posing a practical difficulty.

Thus, when processing color images, a method of transferring the toner deposited on the photoconductive medium onto an intermediate transfer medium, and fusing the toner on the printing medium by heating the intermediate transfer medium has been adopted. That is, a method of electrostatically transferring the toner particles deposited on the photoconductive medium onto an intermediate transfer medium, and fusing the toner particles consisting of a thermoplastic resin, a pigment, etc. into a viscous molten state by heating the intermediate transfer medium and transferring the toner particles onto the printing medium by forcing them onto the printing medium is known. This method is being widely used especially in processing color images since it has advantages that a toner image can be transferred stably without relying on electrical properties, such as resistance values, of the printing medium, and that the printing medium is passed over the intermediate transfer medium only once.

When implementing this method of fixing the toner on the printing medium, a construction as shown in FIG. 16 has been adopted in which an intermediate transfer roll made of a hollow metallic drum is provided as an intermediate transfer medium 15, with a halogen heater installed inside the hollow drum to heat the entire intermediate transfer medium.

With this construction, however, the heat of the intermediate transfer medium 15 whose surface temperature is kept high at all times is readily transmitted to the photoconductive medium 10, adversely affecting the performance of the photoconductive medium 10. If a high-viscosity, high-concentration developer solution consisting of a high-concentration toner dispersed in silicone oil is used, the intermediate transfer medium can be heated in a manner different from the conventional manner without giving adverse thermal effects on the photoconductive medium since the heat capacity of the toner can be reduced due to small toner particles.

In this transfer method, temperature settings for the intermediate transfer medium, the toner, the printing medium and the pressure roller are essential. The temperatures of toner particles and the printing medium at the time when the toner particles come in contact with the printing medium for transfer should preferably be higher than the softening point of the toner particles, so that the toner particles and the printing medium can be brought into close contact by a backup pressure from the rear surface of the printing medium, with the result that transfer is achieved by the adhesion of the fused toner particles or the toner layer. To achieve the aimed transfer efficiency of 100%, it is necessary to heat and fuse the toner particles, which form an image on the intermediate transfer medium, into an integrated film layer, and maintain the adhesion between the surface of the intermediate transfer medium and the fused toner layer at a sufficiently lower level than the cohesive force in the fused toner layer and the adhesion between the fused toner layer and the printing medium.

Moreover, there can be two toner heating methods; the one of heating the entire intermediate transfer medium at all times, and the other of heating the intermediate transfer medium by making contact with the surface thereof as necessary. In both cases, an efficient thermal transfer of a toner image is required, taking into consideration power consumption, ready-to-print capability, changes in the state of toners when different colors are deposited on the intermediate transfer medium, and thermal effects on the photoconductive medium and other processing materials.

DISCLOSURE OF THE INVENTION

This invention has been made, taking into account these background factors. It is therefore the main object of this invention to provide a wet type electrophotography apparatus using a non-volatile, high-viscosity, high-concentration liquid toner and an intermediate transfer medium in which the toner transferred onto the intermediate transfer medium is efficiently heated and fused to transfer the toner image on a printing medium with high quality without causing thermal effects on a photoconductive medium.

It is another object of this invention to provide a construction of the intermediate transfer medium suitable for efficiently heating and fusing the toner.

That is, this invention makes it possible to efficiently heating and fusing the toner transferred onto the intermediate transfer medium without causing thermal effects on the photoconductive medium by locally heating the surface of the intermediate transfer medium at a location before the intermediate transfer medium comes in contact with the pressure roller, taking advantage of the characteristic of the toner that the smaller the toner particle size the smaller becomes the heat capacity of the toner.

This invention can direct the electrically charged toner particles in the toner layer to act on the intermediate transfer medium while preventing the toner particles from migrating from the intermediate transfer medium to the heating roller, in a wet type electrophotography apparatus using a non-volatile, high-viscosity, high-concentration liquid toner as a liquid developer solution, by causing a heating roller having a built-in heat source to come into contact with the intermediate transfer medium to heat and fuse toner particles on the surface of the intermediate transfer medium and apply to the intermediate transfer medium a voltage of the same polarity as that of the charge voltage of the toner particles. By doing this, the "offset" phenomenon in which the toner is deposited on the heating roller as it is heated by its contact with the intermediate transfer medium, or the so-called "image shrinkage" caused by the partial cohesion of toner particles, can be eliminated.

This invention can efficiently heat and fuse the toner transferred on the intermediate transfer medium without causing adverse thermal effects on the photoconductive medium, in a wet type electrophotography apparatus using a high-viscosity, high-concentration developer solution consisting of a high-concentration toner dispersed in silicone oil, by locally heating the surface of the intermediate transfer medium at a location before the intermediate transfer medium comes in contact with the pressure roller, and providing the intermediate transfer medium by forming an elastic material layer having electrical conductivity and heat resistance, and a surface layer having electric conductivity, heat resistance, release properties and silicone oil resistance on the surface of a metallic drum. Furthermore, this invention makes it possible to steadily supply optimal heat energy to the intermediate transfer medium whose temperature falls as the result of its contact with the toner by providing as a heating means a heating belt that is kept in contact with the intermediate transfer medium at the same velocity and providing an internal heat source in the rear side of the heating belt.

BEST MODE FOR CARRYING OUT THE INVENTION

In the following, this invention will be described in more detail in accordance with some embodiments. It will be appreciated that the non-volatile, high-viscosity, high-concentration liquid toner used as a liquid developer solution in this invention is the one consisting of toner particles, such as pigments, dispersed in a liquid carrier (oil).

Figure 1:
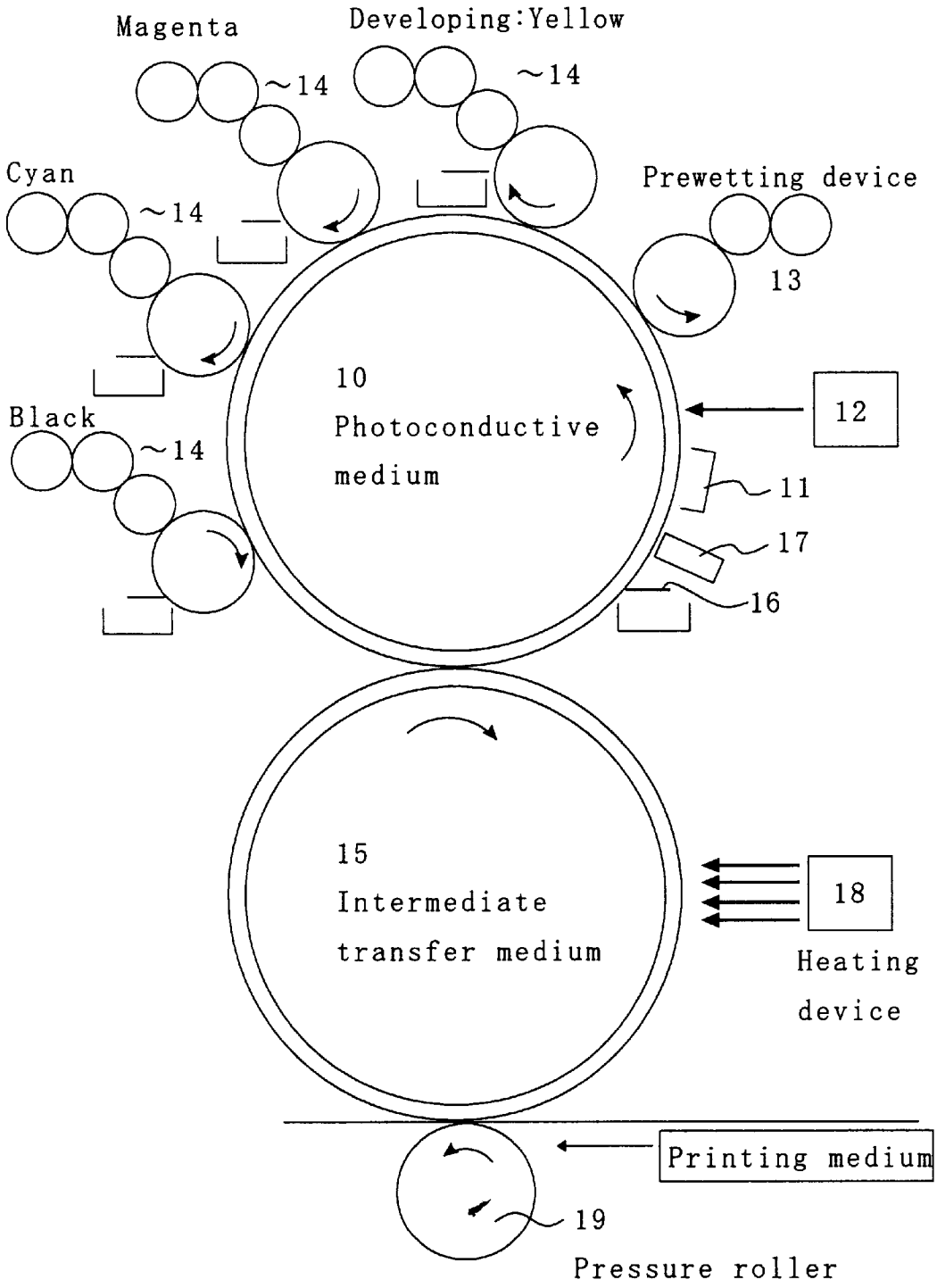
FIG. 1 is a basic schematic diagram of a wet type electrophotography apparatus embodying this invention.

FIG. 1 shows the overall construction of a wet type electrophotography apparatus embodying this invention. As shown in the figure, the wet type electrophotography apparatus comprises a photoconductive medium 10, a charger 11, a light exposure device 12, a prewetting device 13, developing devices 14, an intermediate transfer medium 15, a blade 16, a static eliminator 17, a heating device 18, and a pressure roller 19. The charger 11 electrostatically charges the photoconductive medium 10 to approximately 700 V. The light exposure device 12 exposes the photoconductive medium 10 using a laser beam having a wavelength of 780 nm to form on the photoconductive medium 10 an electrostatic latent image whose potential at exposed areas is approx. 100 V.

The prewetting device 13 is for applying a silicone oil with a viscosity of approx. 2.5 cSt on the surface of the photoconductive medium 10 to a thickness of 4~5 $\mu$m. Note that the prewetting device 13 may carry out prewetting operation either prior to the exposure operation carried out by the light exposure device 12 or after the exposure operation.

The developing devices 14 are provided separately for yellow/magenta/cyan/black.

Figure 2:
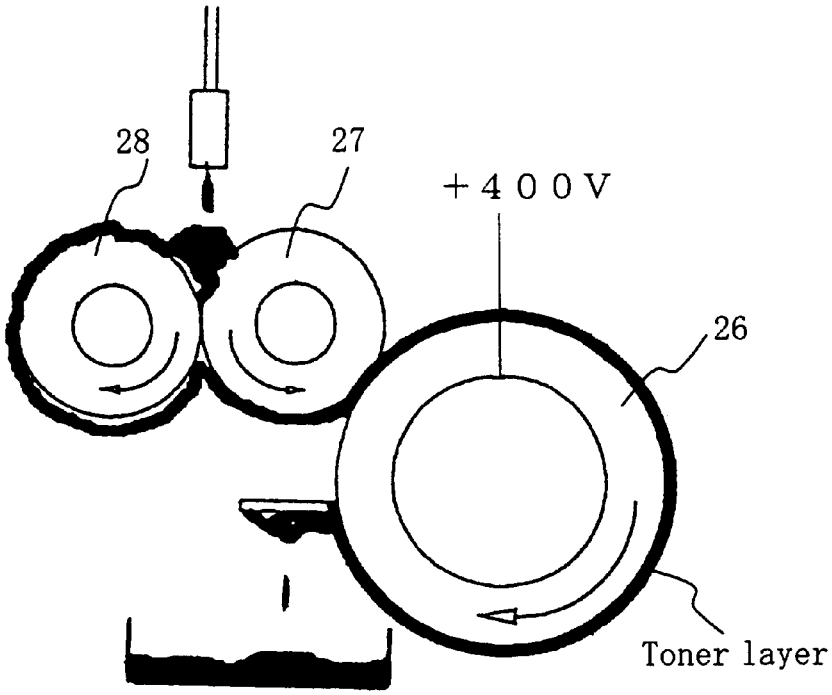
FIG. 2 is a diagram of assistance in explaining the operation of an applicator roller and a developing roller.
Figure 3:
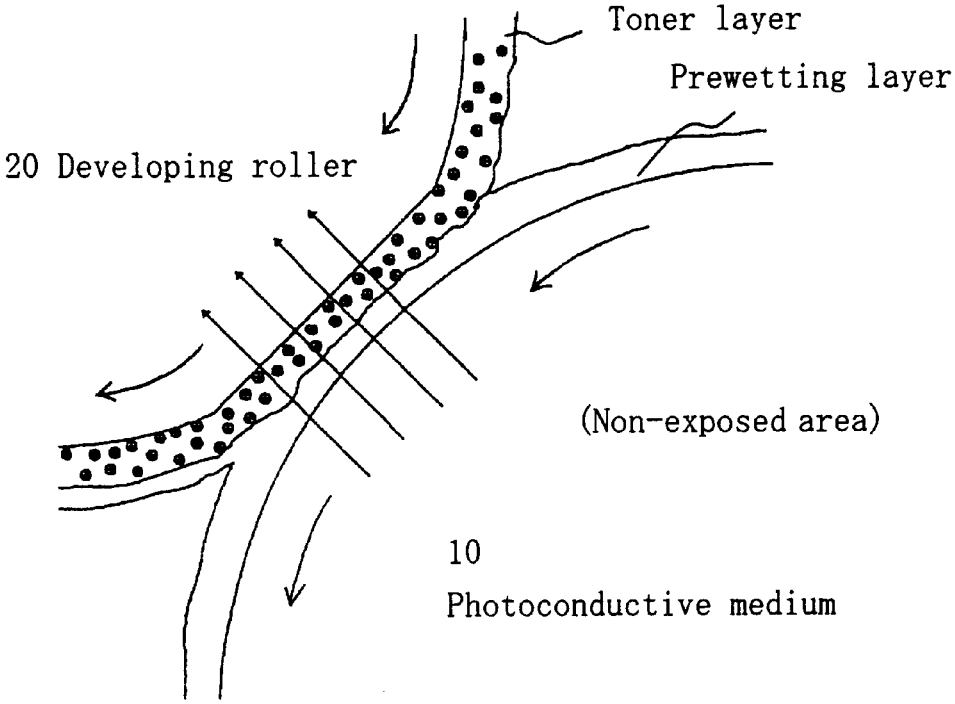
FIG. 3 is a diagram of assistance in explaining the operation of a prewetted layer provided in a prewetting process.

Biased at approx. 400 V, the developing device 14 forms a 2~3 μm-thick toner film on a developing roller 26 as it transfers a liquid toner with a toner viscosity of 40.0~4000 Pa·S and a carrier viscosity of 20 cSt while spreading it into an even thin film from a toner pool using applicator rollers 27 and 28, as shown in FIG. 2. The developing roller 26 supplies the positively charged toner to the photoconductive medium 10 in accordance with the electric field between the developing roller 26 and the photoconductive medium 10 to deposit the toner on the exposed area onto the photoconductive medium charged at approx. 100 V. At that time, the toner can be prevented from adhering to the unexposed area of the photoconductive medium 10, as shown in FIG. 3, in accordance with the prewetted layer applied by the prewetting device 13.

The toner particles deposited on the photoconductive medium 10 is transferred to the intermediate transfer medium 15, which is biased at approx. −800 V, in accordance with the electrical field between the intermediate transfer medium 15 and the photoconductive medium 10. First, the yellow toner particles, then the magenta toner particles, then the cyan toner particles, and the black toner particles deposited on the photoconductive medium 10 are transferred to the intermediate transfer medium 15.

The blade 16 removes the toner and the prewetting solution left on the photoconductive medium 10. The static eliminator 17 eliminate the static charge on the photoconductive medium 10.

The heating device 18 fuses the toner deposited on the intermediate transfer medium 15 by heating the surface of the medium 15, as will be described in detail later. The pressure roller 19 fixes the fused toner on the intermediate transfer medium 15, which has been fused by the heating device 18, onto a printing medium. The wet type electrophotography apparatus according to this invention, which uses the heating device 18 and the pressure roller 19 to fuse and fix the toner deposited on the intermediate transfer medium 15 onto a printing medium without directly heating the printing medium, can handle any printing medium, other than paper.

Next, the heating device for heating the intermediate transfer medium, which is one of main features of this invention, will be described in more detail.

After four-color toners have been transferred in four separate transfer operations from the photoconductive medium 10 to the intermediate transfer medium 15, the toners transferred on the intermediate transfer medium 15 are heated, fused and transferred in a single operation onto a printing medium, such as paper. When heating the intermediate transfer medium 15, the surface of the intermediate transfer medium 15 and the toners transferred thereon must be heated. This intermediate transfer process can be further divided into the following processes.

The first process is a primary transfer process in which each color is statically transferred from the photoconductive medium 10 to the intermediate transfer medium 15. In this process, an image on the photoconductive medium 10 must be transferred at an efficiency of 100% or almost 100% without disturbing the image. Furthermore, the image once transferred on the intermediate transfer medium 15 must be prevented from returning to the photoconductive medium 10. In addition, the same transfer efficiency and quality must be maintained in transferring one color toner on the intermediate transfer medium 15, and another color toner on the previously transferred toner as well.

The second process is a heating and fusing process for heating and fusing the toner. In this process, the toner must be kept in a sufficiently molten state to transfer it on a printing medium while volatilizing all volatile matter. When a contact means, such as a heating roller, heating belt, etc., is used, the toner must be prevented from being transferred to such a contact means, thus degrading the image quality.

The third process is a secondary transfer process for fusing and fixing the toner image onto a printing medium. In this process, 100% of the fused toner must be transferred onto the printing medium.

There is still another process of cooling and cleaning the intermediate transfer medium 15 after the toner on the medium 15 has been fused and transferred to the printing medium.

Figure 4:
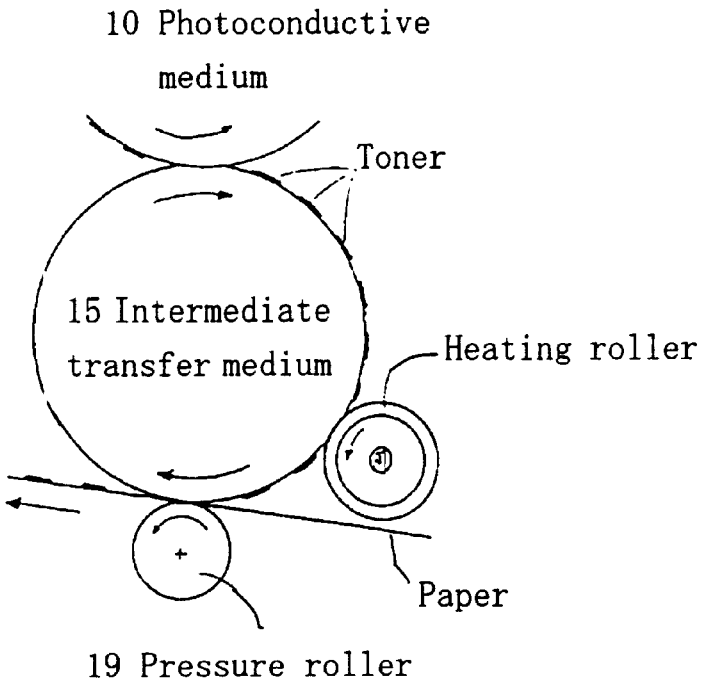
FIG. 4 shows an example of heating the intermediate transfer medium using a heating roller.

FIG. 4 shows an example of the aforementioned process of heating the intermediate transfer medium (which is shown as a roller in the figure, but a belt may also be used, as will be described later). In the example shown in the figure, only the surface of the intermediate transfer medium 15 and the toner transferred thereon are heated to heat the intermediate transfer medium 15. In the figure, a heating roller having a heat source inside is provided outside the intermediate transfer medium 15 in such a manner that the heating roller rotates at a peripheral speed identical to that of the intermediate transfer medium 15. As heat is transmitted by contact between the heating roller and the intermediate transfer medium 15, the surface of the intermediate transfer medium 15 and the toner transferred thereon are heated. A toner release coating layer, such as fluorine coating, may be formed to prevent the toner from adhering to the surface of the heating roller. In addition, the surface layers of the heating roller and the intermediate transfer medium may be made of a metallic material having a good thermal conductivity, such as aluminum or copper, so that heat conduction by contact between the heating roller and the intermediate transfer medium can be improved, maintaining the surface temperature of the intermediate transfer medium at a sufficiently high level.

Figure 5:
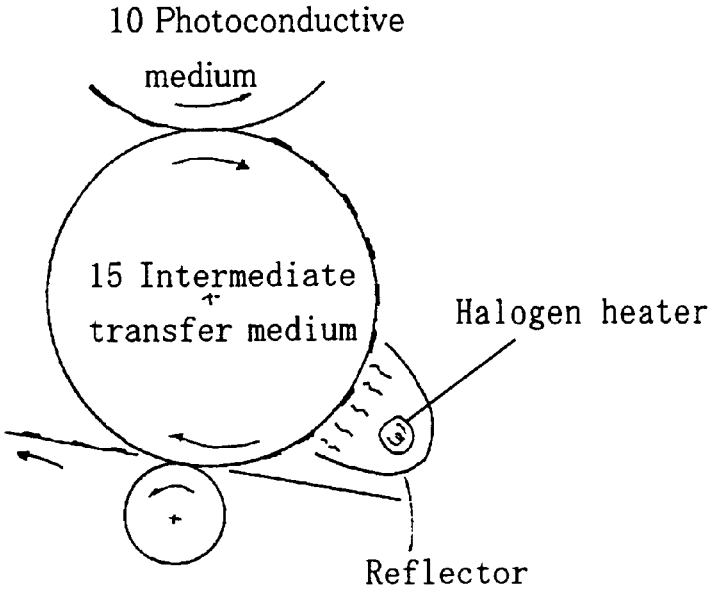
FIG. 5 shows an example of heating the intermediate transfer medium using a halogen-lamp heater.

FIG. 5 shows another example of such an external heat source. In this example, the surface of the intermediate transfer medium 15 can be heated with a non-contact heat source relying on radiation heating, such as a halogen lamp. Furthermore, a reflector is provided to reflect the radiation heat from the halogen lamp toward the intermediate transfer medium 15. Using such a radiation heat source, not only the surface of the intermediate transfer medium 15 but also the toner are heated directly. The radiation heat source should preferably be such that no difference in transfer efficiency and quality is caused among four colors of toners. As such a radiation heat source, a far infrared-ray halogen heater can be used.

Far infrared rays can be collected on the toner image area since the surface of the intermediate transfer medium 15 is finished as a mirror surface or metallic finish surface to reflect the infrared rays radiated from the radiation heat source. The input energy of the far infrared-ray heat can be controlled so that the amount of input energy can be changed in accordance with the amount of toner transferred to the intermediate transfer medium 15 based on the output signal from the laser exposure device or image data, for example. With this arrangement, the toner can be prevented from being excessively heated up for small image areas, and the state of fusion of the toner can be maintained at an optimal level.

By heating the surface of the intermediate transfer medium 15, rather than directly heating the toner, the toner on the surface can be heated indirectly. As a radiation heat source for such an arrangement, a near infrared-ray heater is suitable. Furthermore, by finishing the surface of the intermediate transfer medium 15 into black color that has a high infrared-ray absorption, the efficiency of heating the surface of the intermediate transfer medium 15 can be increased.

The radiance peak for the near infrared-ray type lies in wavelengths of approx. 1 $\mu$m that are close to the visible light region (380 nm ~780 nm). The color of a color toner develops as the toner absorbs (or transmits) a given wavelength region of visible light. Yellow, for example, absorbs blue light of a short wavelength, and reflects green and red light. The black toner has a high absorption, irrespective of wavelengths. If a near infrared-ray type is used, therefore, it is better to heat the toner indirectly through heat conduction by evenly heating the black surface of the intermediate transfer medium, rather than directly heating the color toner.

The output peak for a far infrared-ray type lies in wavelengths of 3~4 $\mu$m. The infrared-ray absorption characteristic of a polymer resin, which is a principal ingredient of the toner, has a peak in the neighborhood of 3 $\mu$m. Infrared-ray heating is particularly efficient when the output peak of the heating device is matched with the absorption-peak wavelengths of an object being heated. The far infrared-ray type can therefore heat the toner evenly, irrespective of (the absorption characteristics of) colors.

Figure 6:
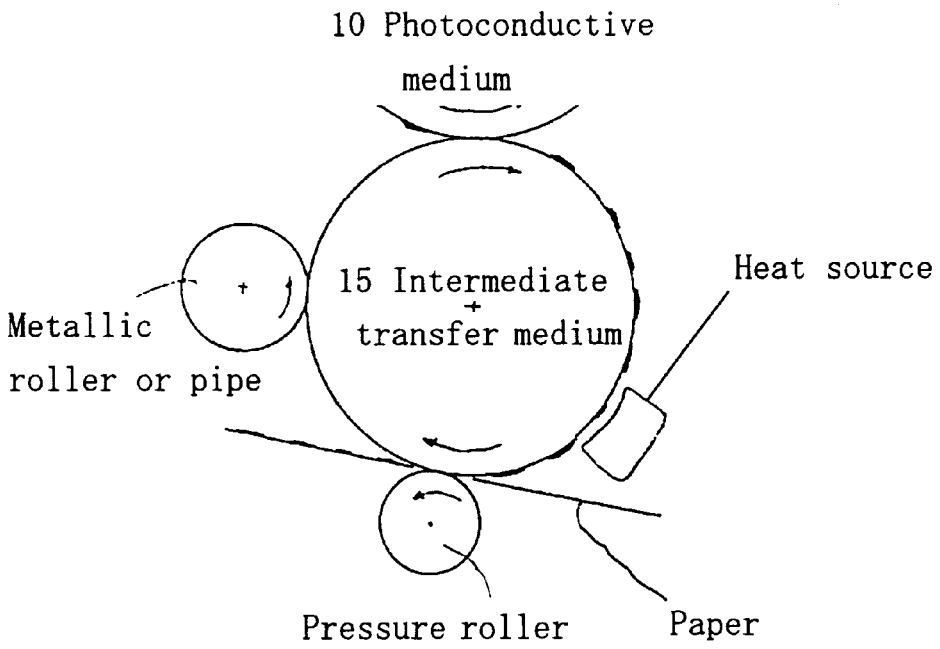
FIG. 6 shows an example of a residual heat cooling means for the intermediate transfer medium.

FIG. 6 shows an example of a residual heat cooling means for the intermediate transfer medium 15. Although the aforementioned intermediate transfer medium designed to have a smaller heat capacity has a good performance in cooling the intermediate transfer medium 15 after the toner has been fused and transferred to a printing medium, such as paper, means for improving the cooling performance can be provided at a location after the toner is fused and transferred. As such means, a metallic roller or pipe may be provided in contact with the surface of the intermediate transfer medium 15 to remove the heat on the surface of the intermediate transfer medium 15 as the cooling means is rotated by the intermediate transfer medium 15. With this arrangement, the secondary heat of the photoconductive medium 10 by the intermediate transfer medium 15 can be prevented. The cooling effect can be further improved by providing ribbed fins inside the cooling metallic pipe and feeding fluid, such as air or water, inside the pipe.

As another example of cooling means, a highly volatile fluid, such as a prewetting solution as used for liquid development, can be applied to the surface of the intermediate transfer medium 15 after the toner has been fused. Or, such a highly volatile liquid can be combined with a cooling metallic roller as mentioned above, from which the liquid is sprayed on the surface of the intermediate transfer medium 15, thereby cooling the intermediate transfer medium 15 by the evaporation heat produced when the liquid is evaporated.

Figure 7:
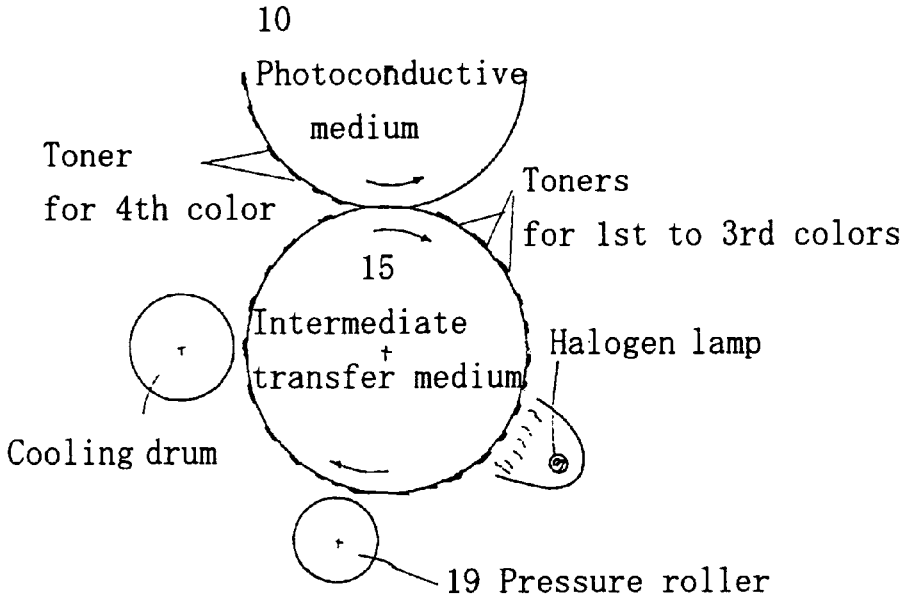
FIG. 7 shows an example of a preheated intermediate transfer medium.

FIG. 7 shows an example of the intermediate transfer medium that is preheated. Although the toners on the intermediate transfer medium 15 is normally heated after each of the four color toners has been transferred from the photoconductive medium 10 onto the intermediate transfer medium 15, as described above, a preheating voltage of such a low level as not to fuse the toner is applied to the halogen lamp before the last of the four color toners is transferred, or when the second or third toner is transferred, for example.

By setting the preheating voltage to small fractions of the rated voltage, the prewetting solution or carrier solution that is not necessary for fusing and transferring the toner can be evaporated, and the startup time of the halogen lamp when the main voltage is applied can be reduced. Furthermore, power consumption at the time of heating the halogen heater at the main voltage can be reduced by preheating the surface of the intermediate transfer medium and the toner.

Figure 8:
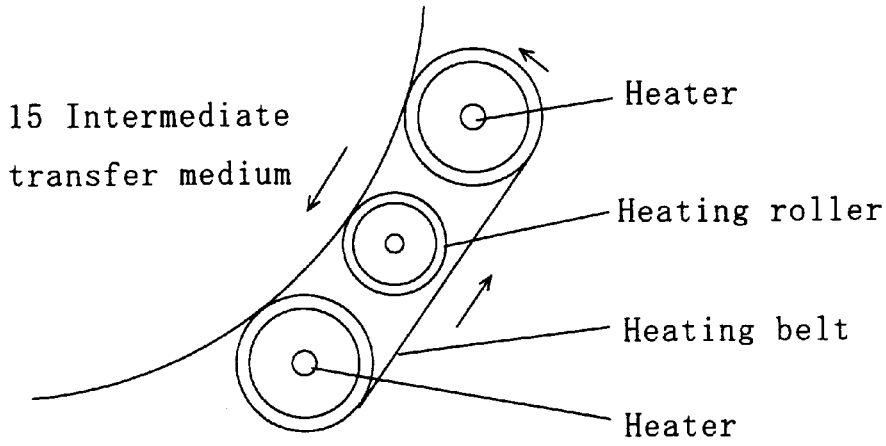
FIG. 8 shows a heating method using a heating belt inside which a heating roller is provided.
Figure 9:
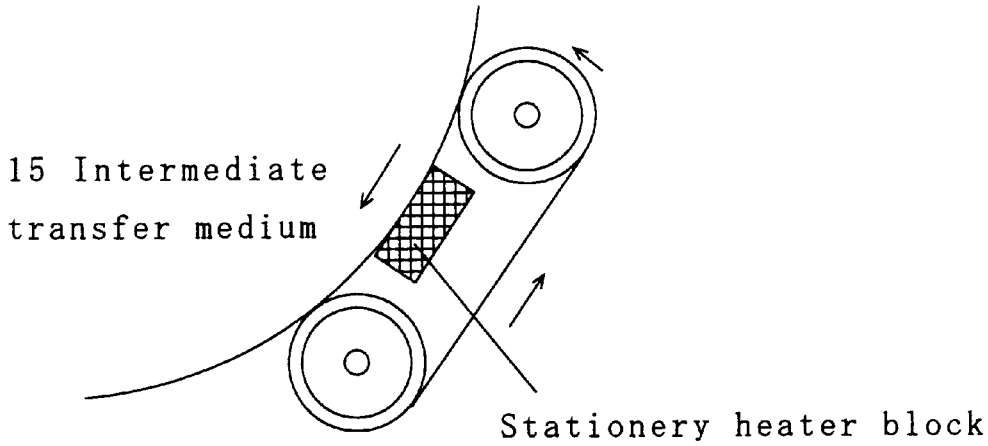
FIG. 9 shows a heating method using a heating belt inside which a stationary heater block is provided.
Figure 10:
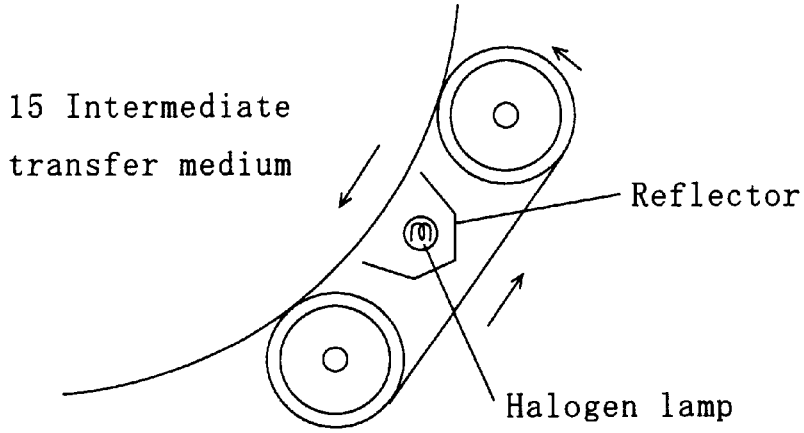
FIG. 10 shows a heating method using a heating belt inside which a halogen lamp and a reflector are provided.

FIGS. 8 through 10 illustrate the method of heating the intermediate transfer medium according to this invention by heating the intermediate transfer medium using a heating belt. In these examples, the heating belt is driven between two rollers, at least one of which comprises a heating roller having a halogen lamp as a heat source. More preferably, both the rollers should be heating rollers so as to increase the contact time between the belt and the heating roller to facilitate the recovery of the heat loss caused during the heating of the toner and the intermediate transfer medium. Heating with a predetermined length of belt makes it possible to ensure a soft contact between the belt and the heating roller and extend the heating time. In this way, the toner image being heated is heated up and fused through heat conduction by contact with the surface.

The entire unit or the base material of the heating belt may be made of a metal having good heat conductivity to improve the supply of heat from the heating belt to the intermediate transfer medium and facilitate the heat recovery of the heating belt. Furthermore, the surface layer of the belt, which heats the intermediate transfer medium and the toner thereon while making contact with them, may be made of a material having good toner releasing performance, such as fluorine coating, to prevent the fused toner from adhering to the heating belt. In other words, the wetting performance with respect to the fused toner of the heating belt surface must be made larger than that of the surface of the intermediate transfer medium, and the wetting performance of the surface of a printing medium must be made even larger than that of the heating belt surface. This allows all the toner heated by the heating belt to remain on the intermediate transfer medium, without adhering to the heating belt, and to be fused and transferred on the printing medium. This can be achieved by applying fluorine coating on the surface of the heating belt, and coating the surface of the intermediate transfer medium with fluorine rubber.

In order to efficiently heating and fusing the toner image on the intermediate transfer medium, it is necessary to increase the thermal energy to be transmitted from the heating belt to the toner image and the surface layer of the intermediate transfer medium. The heat capacity (thickness) of the heating belt that stores thermal energy has its ceiling limit due to its fatigue limits to the repetitive compressive/tensile stresses produced in the belt as it is driven by the rollers. In this regard, the entire unit or base material of the heating belt should preferably be made of a metal having good thermal conductivity so as to improve the heat supply from the heating belt to the intermediate transfer medium and facilitate the heat recovery of the heating belt. A nickel belt of the order of scores of micrometers, for example, can be used in practical applications.

Since the heating belt and the toner image on the intermediate transfer medium come in contact with each other, the state of their contact has an effect on image quality. For this reason, arrangement should preferably be made so that the toner image be brought into contact gently with the so-called "belly" part of the heating belt between the rollers, except those areas coming in contact with the rollers. Such an arrangement can be accomplished by placing the rollers apart from each other. It is also desirable that both the heating belt and the intermediate transfer medium be brought into contact with each other at the same speed to ensure the stable heat-energy supply to the toner on the intermediate transfer medium.

In the examples shown in FIGS. 8 through 10, an internal heat source is provided on the rear side of the belly part of the belt to replenish heat energy to the heating belt whose temperature tends to fall due to heat conduction by contact with the toner.

As shown in FIG. 9, a stationary heater block having a sufficient heat capacity can be provided as an internal heat source by bringing it into sliding contact with the rear side to the belly part of the heating belt to improve and stabilize the efficiency of reheating the heating belt. In such a case, the heater block should be made of a metal having high thermal conductivity, such as copper or aluminum. Thus, the heater block can be a sheathed heater embedded in the block of aluminum, for example. It is also desirable that the part of the stationary heater block at which the heater block comes in contact with the heating block be of a concave curved surface with a curvature equal to or slightly larger than the diameter of the intermediate transfer roller so as to maintain the contact width with the rear side of the heating belt belly part.

Although the stationary heater block is a simple means for conducting heat from the internal heater to the rear side of the heating belt, it has disadvantages such as the instability of the mechanism and reduced service life resulting from chattering (stick slip) due to kinetic friction, and sliding wear. FIG. 8 is an example in which a driven heating roller is provided as an internal heat source on the rear side of the belt.

As shown in FIG. 10, a radiation heat source, such as a halogen lamp, is provided as an internal heat source to supply thermal energy to the heating belt in a non-contact state. At this time, a reflector should preferably be provided around the halogen lamp to focus infrared rays onto the rear side of the belly part of the belt that comes in contact with the intermediate transfer medium 15. Where the rear surface of the heat belt comprises a glossy surface made of nickel, for example, that can efficiently reflect infrared rays, the absorption of infrared-ray energy to the belt can be improved by blackening the rear surface of the belt with a heat-resistant paint, etc.

In order to accomplish a fusing and transferring efficiency of 100%, it is necessary to ensure that the toner particles have been fused and the overlapped toner images have been integrated before the heating of the heating belt is completed. In the liquid developing system using a non-volatile carrier oil, exerting pressure is especially effective to facilitate the coalescence and integration of the fused toner particles. Integration of the toner image is also effective to improve the peeling performance (the state where no offset occurs) of the toner from the heating belt.

In order to facilitate the fusing and integration of the toner on the intermediate transfer medium that is in contact with the heating belt, it is necessary to positively force the belt tension rollers onto the intermediate transfer medium 15. When forcing the belt tension rollers onto the intermediate transfer medium, the belt tension roller on the primary transfer side can be forced onto the intermediate transfer medium 15 only gently to such an extent that the image is prevented from collapsing, or kept in noncontact state with the intermediate transfer medium 15, to allow the toner layer to enter into the contact area between the intermediate transfer medium 15 and the heating belt and to prevent the fused toner image from collapsing. It is desirable that the tension of the tension rollers on the fusing and transfer side be kept at a higher level at the final area where the heating belt comes in contact with the intermediate transfer medium 15 after the toner on the intermediate transfer medium 15 has been fully heated. In this case, the tension rollers help integrate the fully heated and fused toner at the belt contact area with such a slight pressure as not to collapse the toner image, thereby forming a fused toner layer that is free from offset to the belt surface. It is also desirable that the internal heating roller be positively forced onto the intermediate transfer medium.

As will be described in detail later, the belt contact/retract mechanism causes the belt to brought in contact with, and retracted from, the intermediate transfer medium 15 by driving each roller and belt on the whole in a well-organized manner. In addition, pressure force can be applied individually to tension rollers with independent pressurizing mechanisms. Pressure force can also be applied independently to the heating roller and the stationery heater block as internal heat sources. It is desirable that the surface of the belt on which the belt comes in contact with the intermediate transfer medium be tensioned by driving the belt from the belt tension roller on the fusing and transfer side. This ensures the close contact of the belt with the intermediate transfer medium, reducing the thermal resistance due to contact.

Figure 11:
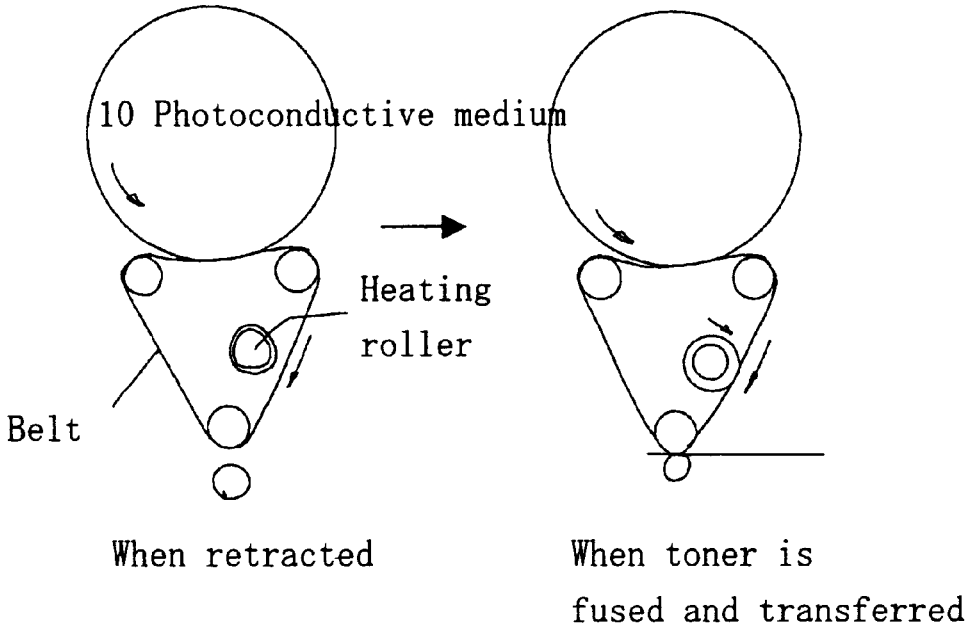
FIG. 11 shows a construction where the heating roller is caused to come in contact with the intermediate transfer medium only during thermal transfer operation.
Figure 12:
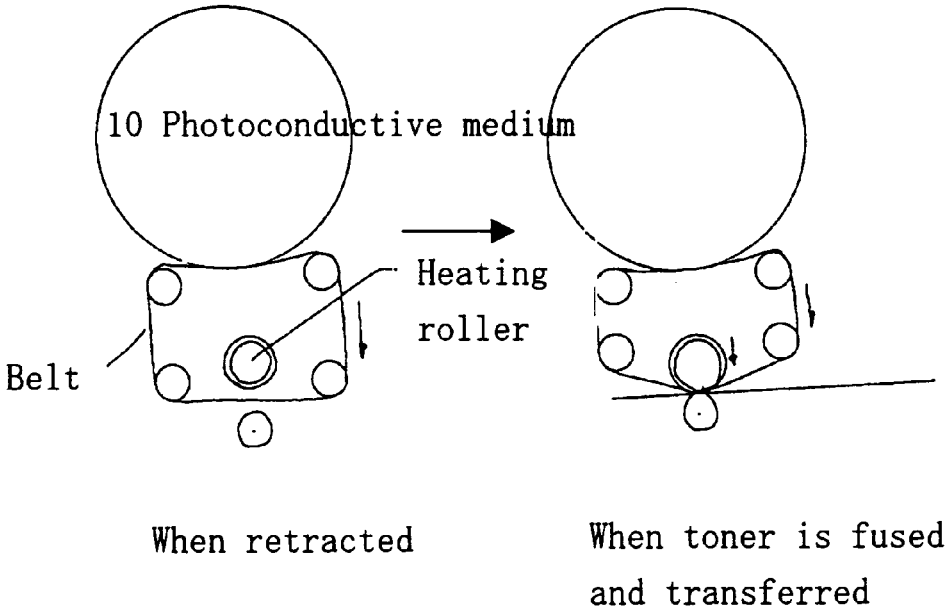
FIG. 12 shows another construction where the heating roller is caused to come in contact with the intermediate transfer medium only during thermal transfer operation.

FIGS. 11 and 12 illustrate the construction in which a belt is used as the intermediate transfer medium where the heating roller is brought into contact with the intermediate transfer medium only at the time of fusing and transfer. FIG. 11 shows an example where an intermediate transfer belt is driven around three small rollers (one of which is also used as a transfer backup roller), whereas FIG. 12 shows an example where an intermediate transfer roller is driven around four small rollers.

In both cases, toners of four colors on the photoconductive medium are transferred on the intermediate transfer belt, and then fused and transferred on a printing medium, such as paper, in a single operation, with the heating roller brought into contact with the belt only at the time of the fusing and transfer of the toners. The left-hand figure each of FIGS. 11 and 12 shows the retracted state where the heating roller is within the belt, but not in contact with the belt. During the period when the heating roller is in the retracted state, the toner of each color is transferred from the photoconductive medium to the belt.

Upon completion of transfer, the heating roller is caused to come in contact with the belt, as shown in the right-hand figure of FIGS. 11 and 12. The heater in the heating roller is turned on and heated up in advance so that the heating roller is heated to an optimal temperature at the time of toner fusing and transfer.

The belt used as an intermediate transfer medium should preferably be made of a material having high heat conductivity, such as a metallic belt, or a material of a thin thickness, such a thin polyimide film. As shown in FIG. 12, this heating roller can also be used as a transfer backup roller by providing it on the printing medium transfer portion.

With this construction, unnecessary heat is not given to the photoconductive drum, nor the toner is fused unnecessarily before the toner is fused and transferred because the belt is heated only when it is needed. Heat can be supplied stably even at the start of feeding of the printing medium without paying attention to the warm-up time for the belt.

Figure 13:
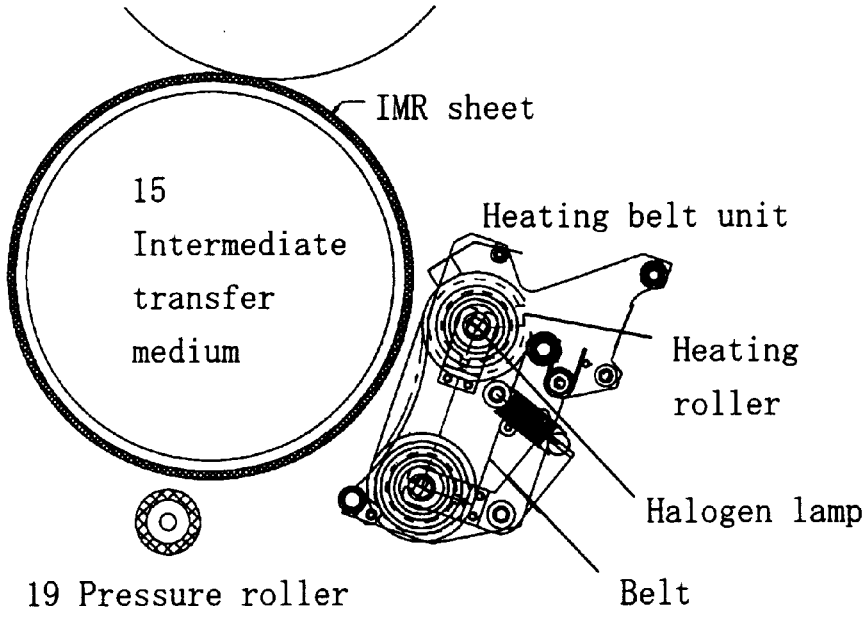
FIG. 13 shows a heating method using a heating belt in which the heating belt is retracted.
Figure 14:
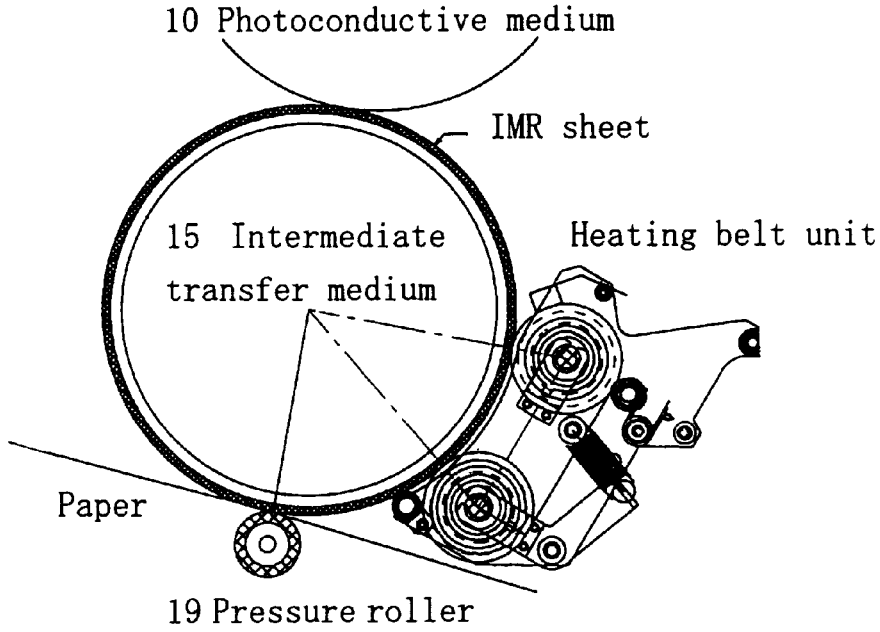
FIG. 14 shows a heating method using a heating belt in which the heating belt is caused to come in contact with the intermediate transfer medium.

FIGS. 13 and 14 illustrate a retract mechanism for a heating belt; FIG. 13 showing the heating belt in a retracted position, and FIG. 14 showing the heating belt coming in contact with the intermediate transfer medium. In this example, the heating belt is driven by two rollers, at least one of which comprises a heating roller having a halogen lamp as a heat source. Both rollers should preferably be made as heating rollers, so that the time of contact between the belt and the heating roller can be increased to facilitate the recovery of the heating-belt temperature which tends to fall as the toner and the intermediate transfer medium are heated. Heating with a fixed length of heating belt makes it possible to heat the toner and the intermediate transfer medium for a longer time while keeping soft contact between the belt and the intermediate transfer medium. In examples shown in the figure, a retract mechanism for a heating belt unit is provided. The heating belt is heated in advance and brought in contact with the intermediate transfer medium 15 only when fusing and transferring the toner, while kept retracted in other occasions.

Since the heating belt and the toner image on the intermediate transfer medium come in contact with each other, the state of contact between them has an effect on the image quality. To cope with this, therefore, only the so-called belly part of the heating belt between the rollers, except for the contact part of the heating belt with the rollers, should preferably be brought into contact gently with the intermediate transfer medium. This can be achieved by separating the rollers apart. To reduce the collapse and spread of the toner image resulting from the contact pressure of the heating belt, an elastic layer made of heat-resistant silicone rubber can be provided on the surface of the heating belt. To reduce the slip due to the difference in peripheral speed between the heating belt and the intermediate transfer medium, it is desirable that the belt be driven by the same drive unit as that of the intermediate transfer medium.

Figure 15:
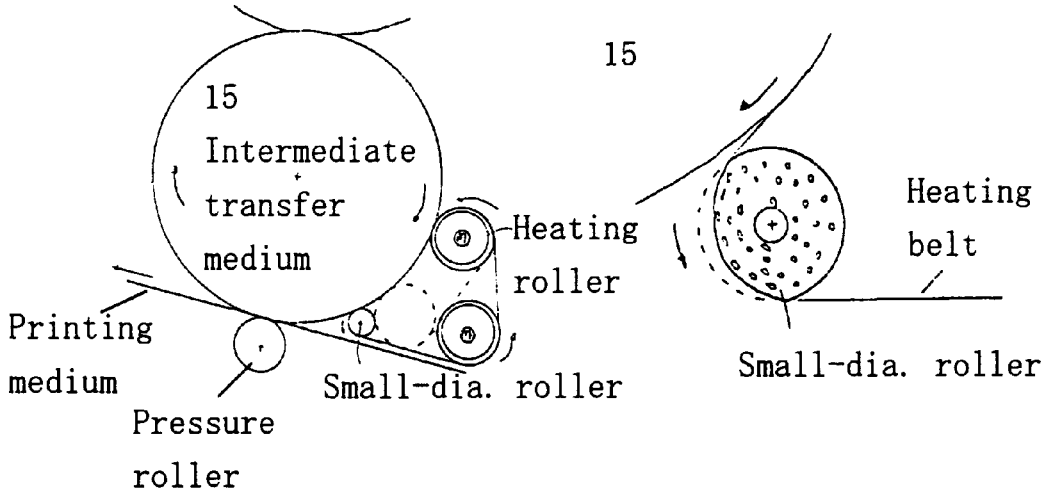
FIG. 15 shows a heating method using three rollers.
Figure 16:
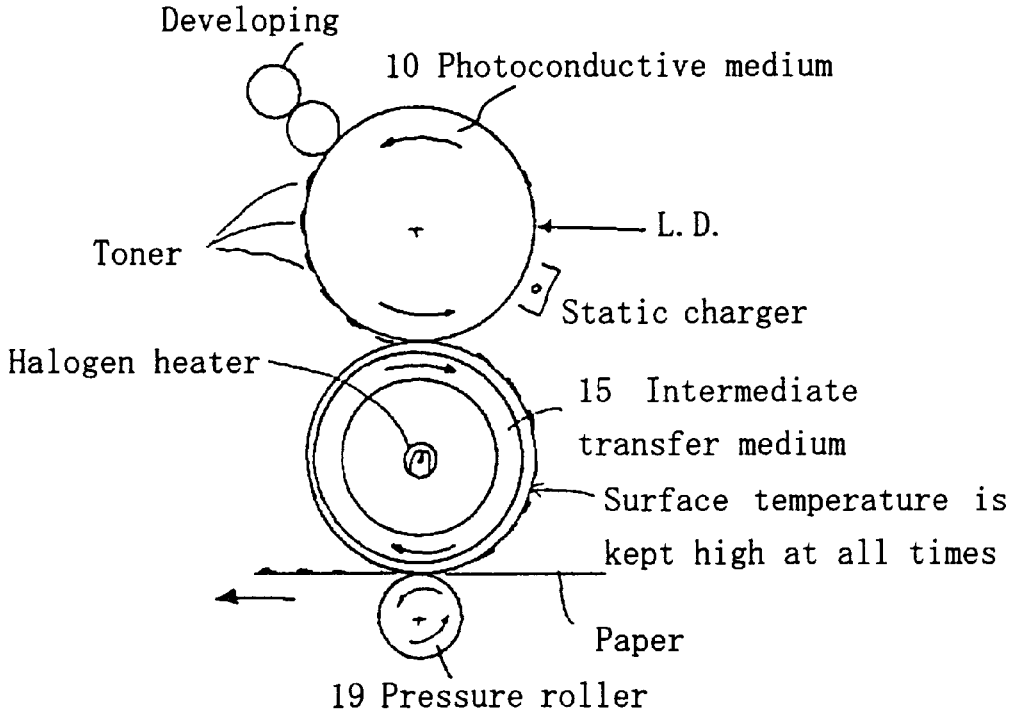
Fig. 16 Prior art
FIG. 16 shows a conventional type of the intermediate transfer medium in which the entire medium is heated with a halogen-lamp heater disposed in the hollow part of a hollow metallic drum.

FIG. 15 shows a heating system using three rollers. After the toner on the intermediate transfer medium is heated, the surface temperature of the toner and the intermediate transfer medium falls due to the heat loss caused by heat convection and heat conduction to a sponge layer inside the intermediate transfer medium before the toner is transferred to a printing medium. It is necessary therefore to reduce the time from the start of heating to the fusing and transfer of the toner. To achieve this, it is desirable that the diameter of the belt driving roller on the fusing and transfer side be made smaller, and the belt driving roller be disposed closer to the pressure roller. Note that the minimum values for the belt thickness and the roller diameter are determined by repetitive compressive stresses.

This problem can be solved by tensioning the belt with three rollers, as shown in the figure, so that the flex of the belt (internal compressive and tensile stresses) can be minimized even when small-diameter rollers are used. With this construction, the printing medium can be preheated because the time in which the heating belt faces the printing medium is increased. By using a heat-resistant sponge roller for the small-diameter roller (silicone rubber), as shown in the right-hand figure of FIG. 15, the sponge roller is elastically deformed by the tension of the belt, with the result that the internal stress caused by the flex of the belt can be reduced to a relatively lower degree for a small-diameter roller.

Figure 17:
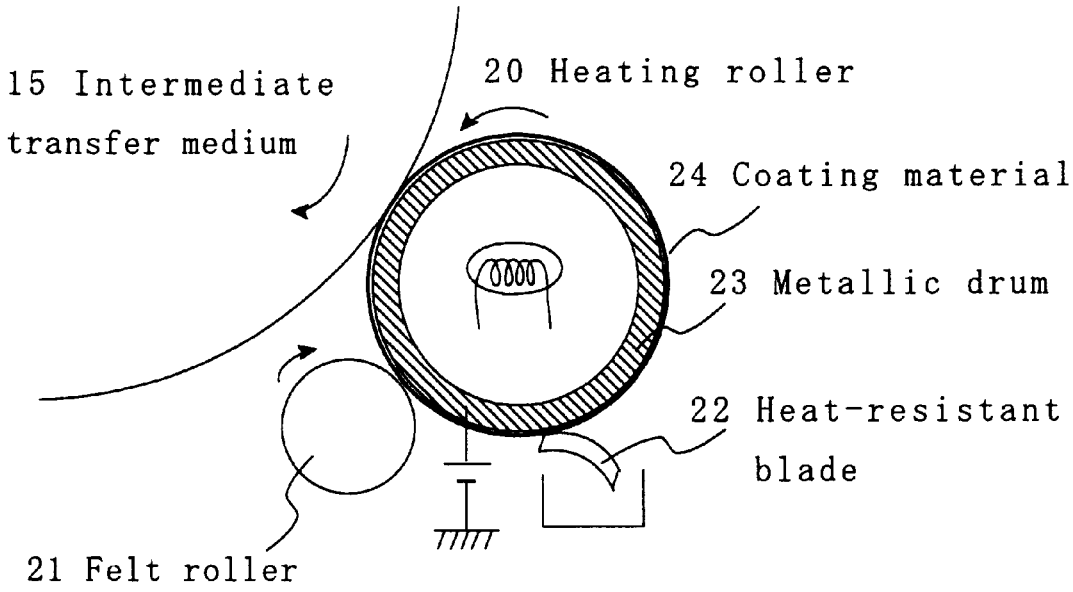
FIG. 17 is an enlarged view of a construction of the heating roller to which a voltage is applied.

FIG. 17 is a diagram showing the construction in which a voltage is applied to a heating roller for heating an intermediate transfer medium to which this invention is applied to prevent the toner from being moved toward the heating roller.

In the figure, a heating roller 20 having a heat source therein is provided outside the intermediate transfer medium 15 as an external heat source for the intermediate transfer medium 15 in such a manner that the heating roller 20 is rotated at the same peripheral speed as that of the intermediate transfer medium 15. The heating roller 20 is disposed so that the heating roller 20 makes contact with the intermediate transfer medium 15 at an appropriate location between the location at which the intermediate transfer medium 15 carries out the primary transfer by making contact with the photoconductive medium (image carrier) 10 and the location at which the intermediate transfer medium 15 carries out the secondary transfer by making contact with the pressure roller 19, or more preferably at a location as close as possible to the secondary transfer location. Although a roller is used as the intermediate transfer medium 15 in the figure, an intermediate transfer belt driven by a plurality of rollers provided therein can be used in place of the intermediate transfer roller. The surface of the intermediate transfer medium 15 and the toner transferred thereon are heated through heat conduction by contact between the heating roller 20 and the intermediate transfer medium 15. A voltage is applied to the heating roller 20 to form an electric field that causes the toner particles charged in the toner layer to move toward the direction of the intermediate transfer medium 15.

The toner particles electrostatically transferred on the intermediate transfer medium 15 are heated up to a fused state by heat conduction by contact with a heating medium, such as the heating roller 20, immediately before the toner particles are fused and transferred to a printing medium, as described above. In the liquid developing system where a on-volatile carrier solution is used, the toner particles on the intermediate transfer medium 15 are intermingled. In such a state, when the toner layer (toner particles and carrier solution) comes in contact with the heating roller 20, the toner tends to be offset when fused, as is often found with the powder toner. In addition to this offset phenomenon, dispersed toner particles also tend to adhere to the heating roller 20 as they are wetted by the carrier solution. In this fusing and transfer process, a voltage for attracting the toner particles on the surface of the intermediate transfer medium 15 toward the intermediate transfer medium 15, preventing the toner particles from being moved toward the heating roller 20 is applied to the heating roller 20 to eliminate the "offset" phenomenon in which the toner adheres to the heating roller 20 due to heat conduction by contact, and the so-called "image shrinkage" due to the partial coalescence of fused toner particles.

The heating roller 20 having therein a heater comprising a halogen lamp, etc. is turned on in advance so that it is heated to an appropriate temperature, ready for use at the time of toner fusing and transfer. Since the contact/retract mechanism allows the intermediate transfer medium 15 to be heated by contact with the heating roller 20 only when it is needed, unnecessary heat is not applied to the photoconductive medium 10, nor is the toner fused prior to the fusing and transfer of the toner. Furthermore, a stable temperature can be obtained even at the start of feeding of the printing medium without paying attention to the heat-up start time. The heat capacity of the heating roller 20 is made larger than that of the resin layer on the surface of the intermediate transfer medium 15 so as to make the toner temperature closer to the preset temperature (100~200° C.) of the heating roller 20.

As shown in FIG. 17, a drum 23 of the heating roller 20 having in the internal space thereof a heater, such as a halogen lamp, is made of a metallic material having good thermal conductivity, such as aluminum, copper, etc., with the surface thereof coated with a semi-electrically conductive coating material, such as a toner-releasing fluorine resin coating. With this arrangement, the surface potential on the heating roller 20 is maintained at the applied voltage. The toner heating efficiency can be improved by a coating material 24 having a thickness of 10~100 μm and a volume resistivity of $10^8$=$10^{12}$Ω·cm.

It is desirable that a liquid toner that contains silicone oil as a carrier and 5~30% of solid matter be used in conjunction with the aforementioned toner heating method, and that the toner image developed on the photoconductive medium using this type of liquid toner and electrostatically transferred on the intermediate transfer medium have a thickness of 1~20 μm. At this time, a potential difference of several kilovolts to several hundred kilovolts is provided between the intermediate transfer medium and the heating roller 20 that heats the solid matter of the toner to the fusing temperature to apply to the heating roller 20 a voltage of the same polarity as that of the charged toner particles with respect to the intermediate transfer medium.

When a liquid toner having a non-volatile carrier is used, the carrier solution is left among the toner particles in the toner image even when the carrier has been removed at the stage prior to the fusing and transfer of the toner. The solid-matter particles in the liquid toner can be separated from the carrier solution since the solid-matter particles coalesce into one piece at a temperature above the fusing temperature of the solid matter. Thus, the effect of removing the carrier during heating can be improved by choosing as the coating material of the heating roller a material having an affinity for the separated carrier solution. If the carrier solution is silicone oil, the surface of the heating roller should be coated with a silicone resin or rubber with an affinity for the silicone-oil carrier solution.

To recover the carrier solution removed from the intermediate transfer medium 15 from the heating roller 20, a heat-resistant blade 22 made of fluororubber can be used, as shown in the figure. In such a case, should the toner offset on the heating roller 20 adheres to the blade surface, the surface of the heating roller 20 may be damaged. To cope with this, it is desirable that a felt roller 21 made of a non-woven fabric member, such as felting, for removing the solid content of the toner be provided in front of the carrier recovery blade.

Figure 19:
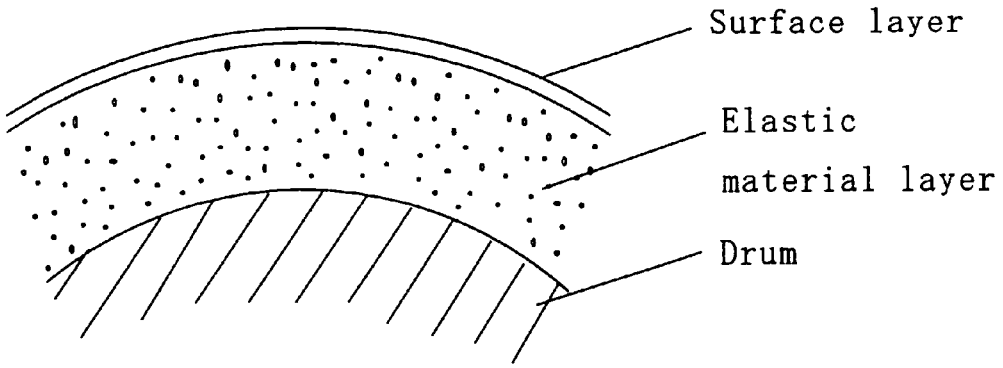
FIG. 19 shows a construction of the intermediate transfer medium according to this invention.

FIG. 19 shows an example of the aforementioned construction of the intermediate transfer medium that is heated by an external heat source.

As described above, the toner electrostatically transferred on the intermediate transfer medium is heated up into a fused state through heat conduction by contact with the heating member, such as the heating roller, immediately before the toner is fused and transferred onto a printing medium. The characteristics required of the intermediate transfer medium are as follows:

- The material of the intermediate transfer medium should have non-tackiness that helps release the fused toner particles.
- The material of the intermediate transfer medium should have heat insulating properties, as found in foam rubber, to cope with the heat-up of the toner.
- The surface layer of the intermediate transfer medium holding the toner should have a low heat capacity.

The intermediate transfer medium comprising a roller as in the example shown, has at the center thereof a drum of a diameter of approximately 150 mm, for example, made of rigid metallic body, such as aluminum. This drum has electrical conductivity so that a voltage can be applied from the shaft, etc. to electrostatically transfer the toner image on the photoconductive medium onto the intermediate transfer medium 15, and hardness necessary to exert a pressure required to fuse and transfer the transferred toner particles on a printing medium, such as paper. An elastic material layer is provided on the drum, and a surface layer is further deposited on this elastic material layer.

The elastic material layer must be provided under the surface layer, and made of a material having elasticity, electrical conductivity, heat resistance and heat insulating properties. As such a material, an electrically conductive sponge, such as electrically conductive foamed silicone, having a thickness of 1.5 mm, a volume resistance of less than $10^6$Ω·cm, and an Asker C hardness of 10~50 degrees can be used. The foamed sponge should preferably be of a closed-cell type in which there is a predominance of non-interconnecting cells. As the elastic material layer, a solid (not porous) rubber having a low elasticity, such as an electrically conductive silicone rubber with an Asker C hardness of 60 degrees, can be used.

On the elastic material layer provided is a heat-receiving thin surface layer. The amount of toner on the intermediate transfer medium changes with different location and the printed image, particularly in full-color printing. To prevent the toner heating temperature from being affected by the changes in the thickness of the toner layer, the heat capacity of the surface layer on the intermediate transfer medium is made sufficiently larger than that of the toner layer. This can be achieved by appropriately selecting the thickness of the surface layer on the intermediate transfer medium with respect to the toner layer having a thickness of 5~6 μm for all four colors, for example. The surface layer must be made of a material having good electrical conductivity, elasticity, heat resistance, resistance to silicone oil, and release properties. It is desirable that the surface layer should have a volume resistance of $10^8$~$10^{11}$Ω·cm, a hardness of JIS A10~50 degrees, a heat resistance of more than 150° C. Furthermore, the surface roughness of the surface layer should be less than the average particle size (1 μm) of the toner. As the surface layer, an electrically conductive fluorine resin, or an electrically conductive PFA or PTFE (with a surface resistance of $10^4$Ω·cm, 30 μm) having heat resistance, release properties, and resistance to silicone oil can be used. As the surface layer, fluoro-silicone rubber, such as Shin-Etsu Chemical's FE61 having electrical conductivity ($10^{11}$Ω·cm), heat resistance, release properties, resistance to silicone oil, can be used.

When the toner particles on the intermediate transfer medium 15 is heated, the intermediate transfer medium 15 itself is also inevitably heated. The heated toner must be held in the fused state until the toner, after separated from the heating belt, is forced onto a printing medium, coming in contact with it. By making the intermediate transfer medium 15 of a layered construction, heat insulation can be improved. By making the intermediate transfer medium 15 of at least a double-layer construction comprising an elastic material layer and a surface layer, the surface heat insulation properties, together with the heating properties, of the intermediate transfer medium can be improved. To maintain the toner temperature closer to the preset temperature (100~200° C.) of the heating belt and roller, the heat capacity of the heating belt and roller is made larger than that of the surface resin layer on the intermediate transfer medium.

With this arrangement, the heat capacity of the entire apparatus can be reduced, leading to reduced heat supply and increased surface temperature. Furthermore, reduced heat capacity results in improved cooling performance after the fused toner particles have been transferred onto a printing medium, such as paper, eliminating the possibility of unnecessarily heating the photoconductive medium. It is desirable that the thickness of the surface layer be as thin as permissible in terms of strength, more preferably 30~150 μm to improve instantaneous heating performance and power consumption.

When the aforementioned solid rubber is used as the elastic material layer, fluorine resin or fluoro-silicone rubber as the surface layer can be formed directly on the elastic material layer by spraying liquid fluorine resin on the drum on which the elastic material layer is formed. This facilitates the manufacturing process.

When a porous material is used as the elastic material layer, it is difficult to spray the surface layer directly on the porous surface of the elastic material layer. To cope with this, a 10~50-μm thick film of the fluorine resin can be wound as the surface layer on the porous elastic material layer.

Figure 20:
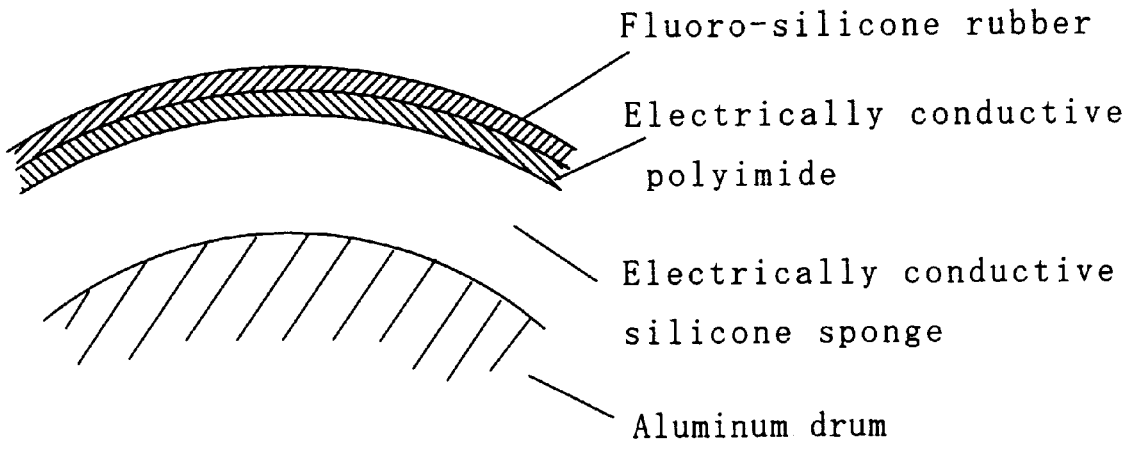
FIG. 20 shows another construction of the intermediate transfer medium according to this invention.

Or, a 10~50-μm thick film of heat-resistant and electrically conductive polyimide (Du Pont's electrically conductive Kapton, 400 μm, for example) to which fluoro-silicone rubber (Shin-Etsu Chemical's FE61, 30 μm) is applied can be used as the surface layer, as shown in FIG. 20. When an about 1.5 mm-thick electrically conductive silicone sponge (103–4Ω·cm) is used as the elastic material layer, with the surface layer being approx. 70 μm thick, the intermediate transfer medium comes in contact with the photoconductive medium in the primary transfer by a butted amount of about 0.1 mm. In this case, it acts as an elastic body due to the elasticity of sponge and fluoro-silicone rubber. When the surface layer makes contact with the heating belt and pressure roller, the sponge layer collapses to a sufficient degree, and adequate pressure can be exerted due to the rigidity of the aluminum roller. In addition, the surface layer is less subject to elongation and compression due to the use of polyimide, resulting is less variation in the image and less degradation of image quality.

Figure 18:
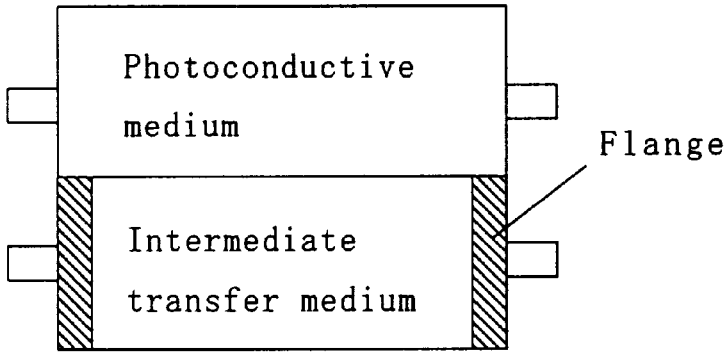
FIG. 18 shows a means for controlling the relative movement of the intermediate transfer medium with respect to the photoconductive medium at a constant level.

It is desirable that the contact area, that is, the nip width, between the intermediate transfer medium and the photoconductive medium be made larger to ensure stable contact with a small pressure between the intermediate transfer medium and the photoconductive medium by increasing the curvature radius of both. As shown in FIG. 18, butt flanges can be provided coaxially on both sides of the intermediate transfer medium to limit the displacement of the intermediate transfer medium to a predetermined level. These butt flanges are provided to keep the distance between the intermediate transfer medium and the photoconductive medium at a constant level, and must be made of an insulating material. The butt flanges may be made of an insulating resin, for example, or an insulating resin layer formed on the surface of a metallic material to ensure accuracy. Using such butt flanges, the intermediate transfer medium, when butted against the photoconductive medium, can maintain the nip pressure between both at an optimal level.

INDUSTRIAL APPLICABILITY

As described above, this invention makes it possible to provide a wet type electrophotography apparatus using a non-volatile, high-viscosity, high-concentration liquid toner and an intermediate transfer medium in which a toner transferred on the intermediate transfer medium can be efficiently heated and fused, without causing thermal effects on a photoconductive medium.

What is claimed is:

1. A wet type electrophotography apparatus using as a liquid developer a non-volatile, high-viscosity, high-concentration liquid toner, comprising:

an image carrier on which an electrostatic latent image is formed;

a prewetting solution applicator to apply a prewetting liquid film on said image carrier;

a developing device to supply a liquid toner as a liquid developing solution to said image carrier by making contact with said image carrier, and causing toner particles to deposit on said image carrier in accordance with an electrical field formed between said developing device and said image carrier;

an intermediate transfer medium on which said toner particles deposited on said image carrier are transferred in accordance with said electrical field formed between said intermediate transfer medium and said image carrier;

a pressure roller to transport a printing medium while forcing said printing medium onto said intermediate transfer medium as said pressure roller rotates in contact with said intermediate transfer medium; and a mechanism to cause a preheated heating device to make contact with said intermediate transfer medium only when needed to locally heat the surface of said intermediate transfer medium at a location before said intermediate transfer medium comes in contact with said pressure roller.

2. A wet type electrophotography apparatus as set forth in claim 1, wherein said heating device comprises a heating roller having a heat source therein, wherein a voltage is applied to said heating roller having the same polarity as the polarity of a static charged to said toner particles with respect to said intermediate transfer medium to prevent said toner particles from migrating to said heating roller.

3. A wet type electrophotography apparatus as set forth in claim 2, wherein the surface of said heating roller is coated with a semi-conductive coating material, said coating material having a thickness of 10–100 μm and a volume resistivity of $10^8$~$10^{12}$ Ω·cm.

4. A wet type electrophotography apparatus as set forth in claim 2, wherein a solution comprising silicone oil as a carrier solution containing 5–30% of solid matter is used as said liquid toner, the thickness of said toner image electrostatically transferred onto said intermediate transfer medium is 1–20 μm, and said voltage applied to said heating roller is several to several hundred kilovolts with respect to said intermediate transfer medium.

5. A wet type electrophotography apparatus as set forth in claim 4, wherein a material having an intimacy with said carrier solution is used as said coating material to improve the effect of eliminating the carrier during heating.

6. A wet type electrophotography apparatus as set forth in claim 4, further comprising:

a heat-resistant blade to recover said carrier solution by making contact with said heating roller; and a roller comprising a non-woven fabric member that contacts said heating roller at a location before said heat-resistant blade in the direction of the rotation of said heating roller.

7. A wet type electrophotography apparatus as set forth in claim 1, wherein said heating device comprises a plurality of rollers in a non-contact state with said intermediate transfer medium, at least one of which is heated from inside, and a belt driven by said rollers to rotate while making contact with said intermediate transfer medium.

8. A wet type electrophotography apparatus as set forth in claim 7, wherein said belt comprises a base material, and at least the base material of said belt comprises a metal.

9. A wet type electrophotography apparatus as set forth in claim 7, wherein said belt comprises a highly heat-resistant elastic layer on the surface thereof.

10. A wet type electrophotography apparatus as set forth in claim 7, further comprising a drive unit to drive said intermediate transfer medium, wherein said belt is driven by the drive unit which drives said intermediate transfer medium, and said belt is adapted to eliminate slips due to differences in peripheral speed between both.

11. A wet type electrophotography apparatus as set forth in claim 7, wherein said belt is driven by three rollers, one roller of which is disposed close to said pressure roller in a proximity of the surface of said intermediate transfer medium and has a smaller diameter than the diameter of the other rollers.

12. A wet type electrophotography apparatus as set forth in claim 7, wherein said belt is brought in contact with said intermediate transfer medium at the same speed, and further comprising an internal heat source on a rear side of said belt to replenish thermal energy to said heating belt, the temperature of which falls due to heat conduction by contact with said toner.

13. A wet type electrophotography apparatus as set forth in claim 12, wherein said internal heat source comprises a stationary heater block in sliding contact with the rear side of said heating belt.

14. A wet type electrophotography apparatus as set forth in claim 13, wherein a portion of said stationary heater block at which said stationary heater block comes in contact with said heating belt is formed into a concave curved surface having a curvature equal to or slightly larger than a diameter of said intermediate transfer medium.

15. A wet type electrophotography apparatus as set forth in claim 12, wherein said internal heat source comprises a heating roller that is rotated as said heating roller is driven in contact with the rear side of said heating belt.

16. A wet type electrophotography apparatus as set forth in claim 12, wherein said internal heat source comprises a radiation heat source to supply thermal energy to said heating belt in a non-contact state.

17. A wet type electrophotography apparatus as recited in claim 16, wherein the radiation heat source is a halogen lamp.

18. A wet type electrophotography apparatus as set forth in claim 16, further comprising a reflector to concentrate radiation heat, and a black heat resistant material provided on the rear surface of said heating belt to facilitate energy absorption.

19. A wet type electrophotography apparatus as recited in claim 18, wherein the black heat resistant material is paint.

20. A wet type electrophotography apparatus as set forth in claim 7, further comprising:

belt tension rollers to drive said belt, the belt tension rollers being forced onto said intermediate transfer medium by a pressure that is as soft as not to collapse an image, and wherein a tension roller on the toner fusing and transfer side at the final part of the contact area of said heating belt is forced onto said heating belt with a slightly stronger force.

21. A wet type electrophotography apparatus as set forth in claim 20, wherein each of said tension rollers exerts a pressure to said intermediate transfer medium independently via a pressure exerting arrangement independent from a belt contact/retract mechanism.

22. A wet type electrophotography apparatus as set forth in claim 20, wherein said heating belt, which is driven by a belt tension roller on the toner fusing and transfer side, has a tight side on the belt surface on which said heating belt comes in contact with said intermediate transfer medium.

23. A wet type electrophotography apparatus as set forth in claim 1, wherein said intermediate transfer medium comprises a belt driven by a plurality of rollers, and the surface of said intermediate transfer medium is locally heated by a heating roller making contact with the rear side of said belt only when toner is transferred to a printing medium.

24. A wet type electrophotography apparatus as set forth in claim 23, wherein said belt comprises a material having a high thermal conductivity.

25. A wet type electrophotography apparatus as set forth in claim 23, further comprising a printing medium transfer section, wherein said heating roller is provided on said printing medium transfer section to serve as a backup roller.

26. A wet type electrophotography apparatus as set forth in claim 1, wherein said heating device includes a device to preheat the toner to such an extent as not to fuse the toner prior to a toner heating and fusing process.

27. A wet type electrophotography apparatus as set forth in claim 1, further comprising a control device to control a heating amount of said heating device in accordance with information about the amount of toner deposited on said intermediate transfer medium.

28. A wet type electrophotography apparatus as set forth in claim 1, wherein said intermediate transfer medium comprises a metallic drum, an electrically conductive, heat-resistant elastic material layer, and a surface layer having electrical conductivity, heat resistance and releasability on the surface of said metallic drum.

29. A wet type electrophotography apparatus as set forth in claim 28, wherein said elastic material layer comprises low-elasticity solid rubber.

30. A wet type electrophotography apparatus as set forth in claim 28, wherein said elastic material layer comprises an electrically conductive porous material.

31. A wet type electrophotography apparatus as set forth in claim 28, wherein said surface layer comprises an electrically conductive fluorine resin or fluoro-silicone rubber.

32. A wet type electrophotography apparatus as set forth in claim 31, wherein said electrically conductive fluorine resin or fluoro-silicone rubber is applied on said elastic material layer by spraying a liquefied form thereof.

33. A wet type electrophotography apparatus as set forth in claim 31, wherein the film form of said electrically conductive fluorine resin or fluoro-silicone rubber is wound on said elastic material layer.

34. A wet type electrophotography apparatus as set forth in claim 28, wherein said elastic material layer comprises an electrically conductive silicone sponge, and said surface layer is formed by coating an electrically conductive polyimide film with fluorosilicone rubber.

35. A wet type electrophotography apparatus as set forth in claim 28, further comprising butt flanges to limit the relative movement of said intermediate transfer medium with said photoconductive medium provided on both sides of said intermediate transfer medium.

36. A wet type electrophotography apparatus using as a liquid developer a non-volatile, high-viscosity, high-concentration liquid toner, comprising:

an image carrier on which an electrostatic latent image is formed;

a prewetting solution application device to apply a prewetting liquid film on said image carrier;

a developing device to supply a liquid toner as a liquid developing solution to said image carrier by making contact with said image carrier, and causing toner particles to deposit on said image carrier in accordance with an electrical field formed between said developing device and said image carrier;

an intermediate transfer medium on which said toner particles deposited on said image carrier are transferred in accordance with an electrical field formed between said intermediate transfer medium and said image carrier;

a pressure roller to transport a printing medium while forcing said printing medium onto said intermediate transfer medium as said pressure roller rotates in contact with said intermediate transfer medium; and an infrared-ray heating device to locally heat the surface of said intermediate transfer medium at a location before said intermediate transfer medium comes in contact with said pressure roller, wherein said intermediate transfer medium comprises an infrared-ray reflective surface.

37. A wet type electrophotography apparatus using as a liquid developer a non-volatile, high-viscosity, high-concentration liquid toner, comprising:

an image carrier on which an electrostatic latent image is formed;

a prewetting solution applicator to apply a prewetting liquid film on said image carrier;

a developing device to supply a liquid toner as a liquid developing solution to said image carrier by making contact with said image carrier, and causing toner particles to deposit on said image carrier in accordance with an electrical field formed between said developing device and said image carrier;

an intermediate transfer medium on which said toner particles deposited on said image carrier are transferred in accordance with said electrical field formed between said intermediate transfer medium and said image carrier;

a pressure roller to transport a printing medium while forcing said printing medium onto said intermediate transfer medium as said pressure roller rotates in contact with said intermediate transfer medium; and an infrared-rave heating device to locally heat the surface of said intermediate transfer medium at a location before said intermediate transfer medium comes in contact with said pressure roller, wherein said intermediate transfer medium comprises an infrared-ray absorbing surface.

* * * * *